US010843843B2

(12) United States Patent
Eckert et al.

(10) Patent No.: US 10,843,843 B2
(45) Date of Patent: Nov. 24, 2020

(54) FLIP-TOP CONTAINER WITH IMPROVED RESISTANCE AGAINST BREAKAGE AT THE HINGE CONNECTION

(71) Applicant: NESTEC S.A., Vevey (CH)

(72) Inventors: Sebastian Eckert, Frankfurt (DE); Rafael Schraml, Konolfingen (CH); Marco Vierling, Mainz (DE); Martin Zelosko, Wiesbaden (DE)

(73) Assignee: Societe des Produits Nestle S.A., Vevey (CH)

( * ) Notice: Subject to any disclaimer, the term of this patent is extended or adjusted under 35 U.S.C. 154(b) by 140 days.

(21) Appl. No.: 15/524,179

(22) PCT Filed: Nov. 3, 2015

(86) PCT No.: PCT/EP2015/075608
§ 371 (c)(1),
(2) Date: May 3, 2017

(87) PCT Pub. No.: WO2016/071344
PCT Pub. Date: May 12, 2016

(65) Prior Publication Data

US 2017/0355484 A1 Dec. 14, 2017

(30) Foreign Application Priority Data

Nov. 4, 2014 (EP) ..... 14191653

(51) Int. Cl.
*B65D 5/54* (2006.01)
*B65D 77/02* (2006.01)
(Continued)

(52) U.S. Cl.
CPC ..... *B65D 5/543* (2013.01); *B65B 43/10* (2013.01); *B65D 5/4266* (2013.01); *B65D 5/5425* (2013.01); *B65D 77/02* (2013.01)

(58) Field of Classification Search
CPC .... B65D 5/543; B65D 5/4266; B65D 5/5425; B65D 5/54; B65D 5/66; B65D 5/20; B65D 5/42; B65D 5/64; B65B 43/10
(Continued)

(56) References Cited

U.S. PATENT DOCUMENTS 2,967,010 A * 1/1961 Cuffey, Jr. ..... B65D 5/54 206/449
5,332,147 A * 7/1994 Sorenson ..... B65D 5/6626 229/114
(Continued)

FOREIGN PATENT DOCUMENTS

EP 1640292 A2 * 3/2006 ..... B65D 5/4291
FR 2197774 3/1974
(Continued)

*Primary Examiner* — Chelsea E Stinson
*Assistant Examiner* — Mary C Hibbert-Copeland
(74) *Attorney, Agent, or Firm* — K&L Gates LLP

(57) ABSTRACT

The invention relates to a container (1) comprising a main part and a lid (8)which is rotationally moveable around a folding line (21) in a rear panel (5) of the container (1). Parallel and spaced apart transverse cuts (31) are provided at or near a central part of the folding line (21), the transverse cuts (31) extending substantially symmetrically across and perpendicular to the folding line. An end cut (32) may be arranged near but at a distance from each end of the folding line (21), the end cuts (32) going through the thickness of the rear panel (5), and the folding line (21) being perforated between the end cuts (32) and the end of the folding line (21) adjacent to the side panels (4). The end cuts (32) may be in the form of two linear and coherent sub-cuts arranged non-perpendicular to the folding line (21).

15 Claims, 9 Drawing Sheets

(51) Int. Cl.
*B65D 5/42* (2006.01)
*B65B 43/10* (2006.01)

(58) Field of Classification Search
USPC ..... 53/473; 229/146, 225, 114
See application file for complete search history.

(56) References Cited

U.S. PATENT DOCUMENTS

| | | | | |
|---|---|---|---|---|
| 2003/0116614 | A1* | 6/2003 | Block | B65D 5/4291 229/146 |
| 2006/0071061 | A1* | 4/2006 | Velazquez | B65D 5/543 229/225 |

FOREIGN PATENT DOCUMENTS

| | | | | |
|---|---|---|---|---|
| FR | 2197774 | A1 * | 3/1974 | B65D 5/543 |
| JP | 2000159223 | | 6/2000 | |
| JP | 2006225007 | | 8/2006 | |
| JP | 2006225007 | A * | 8/2006 | |
| JP | 2010275009 | | 12/2010 | |

* cited by examiner a)

b)

c)

| Sample no | Force [N] |
|---|---|
| 1 | 10.50129 |
| 2 | 9.03294 |
| 3 | 7.25334 |
| 4 | 7.14427 |
| 5 | 9.00672 |
| 6 | 7.66243 |
| 7 | 3.90018 |
| 8 | 8.97461 |
| Maximum | 10.50129 |
| Median | 8.31852 |
| Minimum | 3.90018 |
| Average | 7.93447 |
| STD | 1.98079 |

d)

| Sample no | Force [N] |
|---|---|
| 1 | 4.54848 |
| 2 | 2.55261 |
| 3 | 2.12143 |
| 4 | 0.5579 |
| 5 | 5.32105 |
| 6 | 3.01498 |
| 7 | 0.95428 |
| 8 | 1.88226 |
| Maximum | 5.32105 |
| Median | 2.33702 |
| Minimum | 0.5579 |
| Average | 2.61912 |
| STD | 1.64729 |

e)

Fig. 9, continued a)

FLIP-TOP CONTAINER WITH IMPROVED RESISTANCE AGAINST BREAKAGE AT THE HINGE CONNECTION

CROSS REFERENCE TO RELATED APPLICATIONS

The present application is a National Stage of International Application No. PCT/EP2015/075608, filed on Nov. 3, 2015, which claims priority to European Patent Application No. 14191653.6, filed on Nov. 4, 2014, the entire contents of which are being incorporated herein by reference.

FIELD OF THE INVENTION

The present invention relates to flip-top containers, and in particular to flip-top containers which have a high resistance against damage of the hinge connection between the lid and the main part of the container during repeated opening and closing of the lid.

BACKGROUND OF THE INVENTION

A container with a hinged lid is often referred to as a flip-top container, flip-top box or flip-top package. Such flip-top containers are used for numerous packaging purposes. A typical use is for storing of food products and typically for content which is to be consumed in portions over a period of time, such as milk powder. However, other uses are also possible. The content of the container may be contained in one or more pouches stored inside the container. An example of a flip-top container is disclosed in U.S. Pat. No. 3,078,030.

The opening of the lid of a flip-top container can result in damaging of the hinged connection between the lid and the remainder of the container, especially when the container is made from a material which is relatively easily damaged, such as cardboard. This damage typically starts at the ends of the folding line forming the hinge due to the notch effect at that position. The damage is partly due to the tearing force itself applied to open the lid. But it is also due to the bulging of the rear panel, especially for containers made of relatively flexible material. This is particularly a problem, when the container is used to store content which is to be consumed in portions over a period of time. For such use, the repeated opening and closing of the container may result in increased amount of damage. Furthermore, the damage in that case can result in undesired exposure of the content of the container to the surroundings, including the risk of some of the content falling out. On known containers the damage is typically counteracted by applying a reinforcing tape on the inside of the hinge which adds cost and complexity on the production lines. Alternatively or in combination therewith, thicker or more tear-resistant material may also be used, which again adds to the cost.

Flip-top containers as described above may comprise perforation lines on the front panel and side panels which are to be broken as part of the first opening of the container, whereas the lid stays hingedly connected to the rear panel of the container. With prior art containers, these perforation lines are typically in the form of rows of straight perforations arranged along what is to form the front and side edges of the lid. In order to be able to open the lid, the perforation lines are intended to be manually pressed along all the sides of the container having the perforation lines. However, it has turned out that many consumers are not aware of this being necessary and therefore intuitively try to open the lid after breaking the perforation line on the front panel only. This easily results in damaging the container during subsequent attempts to pull the lid open.

A further experienced problem with flip-top containers having the type of perforation lines as described is that the perforations sometimes break during transportation. This may result in unwanted openings to the content of the container, or in the container being in a condition which makes it unsuitable for sale to consumers.

A further drawback of known flip-top containers is that they often suffer from the drawback of being difficult to re-close.

Hence, an improved container would be advantageous, and in particular a container having a higher resistance against damage at the hinge connection would be advantageous.

OBJECT OF THE INVENTION

It is an object of the present invention to provide a container having a higher resistance against damage of the hinged connection between the lid and the remainder of the container during opening of the lid, and in particular during repeated opening and closing of the lid.

It is another object to the present invention to provide a container having a higher resistance to bulging of the rear panel when the lid is opened than what is seen with known containers.

It is an object of at least some embodiments of the present invention to provide a container having a lower re-closing force when the container is opened than for known containers.

It is an object of at least some embodiments of the present invention to provide a container which is easier and more intuitive to open without damaging the container than known containers.

It is another object of at least some embodiments of the present invention to provide a container which provides less resistance to intended manual opening than known containers so that less force is to be applied for opening the container.

It is another object of at least some embodiments of the present invention to provide a container which provides higher resistance to damage, such as unintended opening of part of the perforation lines, during transportation.

It is another object of some embodiments of the present invention to provide a container which provides efficient and/or reliable reclosing.

It is a further object of the present invention to provide an alternative to the prior art.

In particular, it may be seen as an object of the present invention to provide a container that solves the above mentioned problems of the prior art.

SUMMARY OF THE INVENTION

Thus, the above described object and several other objects are intended to be obtained in a first aspect of the invention by providing a container comprising:

- a main part comprising a bottom panel, a front panel, two side panels and a rear panel, and
- a lid which is rotationally moveable around a folding line in the rear panel between a closing position where the lid closes the container, and an open position where an open end of the main part of the container is not covered by the lid wherein at least two parallel and spaced apart transverse cuts are provided at or near a central part of the folding line, the transverse cuts perforating the rear panel through the thickness, and the transverse cuts extending substantially symmetrically across and perpendicular to the folding line.

Studies performed in relation to the present invention have shown that the inclusion of such transverse cuts significantly reduces, or even removes, the bulging of a container; this will be described in more details in relation to the figures. Hereby the damage to the folding line which is observed on known containers can be avoided or at least significantly reduced.

In a presently preferred embodiment of the invention, the container further comprises a top panel, and the front panel and the two side panels each comprises a division line, the division lines in the side panels extend from the rear panel to the front panel, and the division line in the front panel extends between and connects the two division lines in the side panels, thereby defining the lid comprising the top panel and upper sections of the front panel and of the side panels, respectively, above the division lines.

In some embodiments of the invention, embossing lines connect the ends of the transverse cuts. Embossing may also be provided along the folding line in the rear panel. Such embossing is typically provided in the material from which the container is made in order to facilitate the desired folding of the material during opening of the lid. The embossing may e.g. be made by the die cutting tool used to make the sheet material from which the container is typically made.

The number of the transverse cuts may be two, and they are then typically arranged symmetrically around a midpoint of the folding line. The length of the transverse cuts may depend on the size of the container, and an optimal length can be determined e.g. from experiments. Possible total lengths are 20 to 40 mm, such as 20 to 30 mm or 30 to 40 mm.

A container as described above may further comprise an end cut provided near but at a distance from each end of the folding line, the end cuts going through the thickness of the rear panel, and the folding line being perforated between the end cuts and the end of the folding line adjacent to the side panels. The presence of such end cuts have shown to further minimize the risk of damage at the ends of the folding line, because the forces are spread over a larger area and in different directions instead of only one. The end cuts may extend substantially symmetrically across the folding line.

Each of the end cuts may be provided in the form of two linear and coherent sub-cuts arranged non-perpendicular to the folding line. The angle between the coherent sub-cuts may be between 90° and 175°, such as between 100° and 170°, such as between 110° and 150°, such as between 120° and 130°, such as 125°. Alternatively the sub-cuts may be along one line and thus be perpendicular to the folding line; i.e. having an angle of 180°. In an alternative embodiment, the end cuts may be arc-shaped. Exactly which design of the end cuts to use for a given design of a container, including the type and thickness of the material used, can be determined e.g. by experimentation.

In some embodiments of the invention, the folding line may further comprise a row of discontinuous perforations extending along the folding line. This has been found to reduce the re-closing force when the container has been opened. These perforations may further ease the first opening of the lid along the folding line and thereby reduce the risk of bulging which could otherwise induce damage to the folding line as described above.

In the embodiments comprising division lines as described above, the division lines may be perforation lines each comprising a row of perforations which are to be broken to enable opening of the lid. Hereby a container is obtained in which the openable lid is obtained by manually breaking the perforations as part of the first opening of the container. This means that no further closure means are needed to keep the container closed after filling and until use.

In embodiments of the invention comprising such perforation lines, the container may be further characterized in that the perforation line in the front panel is a row of perforations arranged along a line or curve which forms an edge of the lid after the perforations have been broken, and each of the perforation lines in the side panels is a row of perforations each comprising two coherent first and second cuts with a blunt angle there between, these perforations being arranged to provide a row of tooth-shaped regions, where each tooth-shaped region is delimited by a first cut and a second cut, respectively, from two mutually adjacent but non-coherent perforations, and the first cuts are arranged parallel to each other but staggered so that they are not arranged along one line.

This combination of the two different types of perforation lines in the front panel and in the side panels, respectively, results in a container which is easy to open. This is the case since it is only necessary to open the perforation line in the front panel by manually applying a pressing force thereto, whereupon the perforation lines in the side panels easily open by applying an upwards directed pulling force to the lid. This self-opening effect is due to the tooth-shaped regions and the arrangements thereof. By "self-opening" is preferably meant that it is not necessary to break these perforations before the opening of the lid is made possible; they break during the first opening of the lid. Several possible designs of the perforations in the side panels have been tested, and those described above have proven to be the most efficient. Hereby a more intuitive opening is obtained compared to other known containers having also the perforation lines on the side panels in the form of rows of perforations arranged on a line or curve.

Another object of the invention which is being met by the design comprising tooth-saped perforations as described above is a higher resistance to damage, such as un-intended opening of part of the perforation lines, during transportation as compared to known containers. Experimental tests performed as part of the development of containers according to the invention have shown that the claimed design and arrangement of perforations fulfil this purpose.

In some embodiments of the invention, the perforation lines in the side panels are downwardly sloping from the rear panel. It has been found during experiments performed in relation to the present invention, that at least for some sizes and shapes of containers, it is easier to open the container after having broken the perforation line on the front panel only, if the perforation lines in the side panels are not horizontal.

The tips of the tooth-shaped regions may be directed towards the rear panel. This will result in an easy opening needing less force to be applied than for other orientations of the tips. By "tip" is preferably meant the narrowest end of a tooth-shaped region, i.e. at the end where the distance between to two adjacent perforations is smallest.

The blunt angle between first and second cuts of the perforations in the side panels may be between 145° and 175°, such as between 155° and 165° or between 165° and 175°. Exactly which angle to choose for a given application can be determined e.g. by experimentation or by computer simulations.

The smallest distance between two perforations on the side panels may be between 0.5 and 3 mm, such as between 1 and 2 mm, preferably approximately 1 mm. This distance is preferably to be taken as the smallest distance when measured perpendicular to a first cut of a perforation towards the adjacent perforation. Exactly which distance to choose for at given application will depend on a number of parameters including the thickness and tear strength of the material from which the container is made, the width of the cuts and the overall inclination angle of the perforation lines with respect to horizontal.

The length of the first cuts of the perforations on the side panels may be between 8 and 16 mm, such as 10 to 14 mm, such as 11 to 13 mm.

As for the blunt angles mentioned above, a final design of the tooth-shaped perforation lines can be determined e.g. by experimentation or by computer simulations.

In the embodiments as described above comprising division lines in the front and side panels:

- the division line extends downwardly sloping from the rear panel in the side panels and horizontally in at least a part of the front panel,
- the front panel may further comprise an inner front part extending above the division line in the front panel without being attached to the front panel above the division line,
- each side panel may further comprise an inner side part extending above the division line in the side panel without being attached to the side panel above the division line, the upper margin of each of the inner side parts extending downwardly sloping towards the rear panel, and
- the inner front part may comprise a flap extending downwardly from an upper margin of the inner front part and abuting an inner surface of the section of the front panel above the division line when the lid is in the position where it closes the container.

By the provision of the division line on the side panels sloping downwardly from the rear panel (thereby providing a lid with corresponding sloping), of inner side parts having upper margins downwardly sloping towards the rear panel and of the flap extending downwardly from an upper margin of the inner front part, an easier closing is achieved. The sloping margins in combination with the flap provide a guiding of the lid during its rotation towards closing of the container, which may guide the panels sections of the lid outwardly—and/or guide the inner front part and inner side parts inwardly—so as to at least mitigate the risk of the lid to engage un-intentionally with the inner front and/or the inner side part.

The inner front part may be provided by a panel provided on the inside of the front panel below the division line in the front panel, and the inner side parts are provided by panels provided on the inside of the side panels below the division line. It is noted that the inner front part and the inner side parts are not necessarily attached to the inside of the side panels and front panel.

In the embodiments comprising a flap as described above, the lid may comprise a ledge provided on the inner surface of the section of the front panel above the division line in a position where the lower margin of the downwardly extending flap engages with an upper edge of the ledge, when the lid is in the position where it closes the container.

Furthermore, for such embodiments comprising a flap, a distance may be provided between the upper margin of the inner front part and the inner surface of the top, when the lid is in the position where it closes the container.

Preferably, the corners of the flap and/or the corners of the inner front part are rounded and/or truncated. Typical and preferred size for the truncation is between 70 and 30°, preferably between 60 and 40°, most preferably around 45°.

A vertical distance may be provided between the upper most part of the inner side parts and the upper margin of the inner front part from which the flap extends downwardly, so that the upper margin of the inner front part is provided at a higher position than the upper most part of the inner side parts.

The container may preferably be made from paper, cardboard, metal and/or plastic, or of a laminate thereof, depending of the intended use of the container, including whether or not the product being stored therein is contained in a pouch. Most preferably, the container is made of paper and/or cardboard.

The container may be made from one or more sheet of material being folded and glued and/or welded to form the container.

The container may contain at least one pouch stored inside the container, which pouch is accessible after opening the lid. This may be desired e.g. for products requiring better protection against moisture than what can be provided by the container itself during transportation, storage and after opening of the container. It may also ensure better protection of the content in case the container is damaged during transportation. The container may be used for storing two or more pouches so that part of the content can be accessed at a time, e.g. to prolong the shelf life if the product needs to be protected against air and moisture for as long as possible.

A second aspect of the invention relates to the use of a container as described above for storing of a food product. Such a use may e.g. be for storing of milk powder.

The first and second aspects of the present invention may each be combined. These and other aspects of the invention will be apparent from and elucidated with reference to the embodiments described hereinafter.

The invention further provides a method of producing a container of the invention, the method comprising folding the panels from one piece of material or joining separate sheets of material.

The invention further provides for the use of a container of the invention for storing of a food product. Such food product is preferably milk powder. Most preferably it is an infant formula powder.

BRIEF DESCRIPTION OF THE FIGURES

The container according to the invention will now be described in more detail with regard to the accompanying figures. The figures show one way of implementing the present invention and is not to be construed as being limiting to other possible embodiments falling within the scope of the attached claim set.

DETAILED DESCRIPTION OF AN EMBODIMENT

Figure 1:
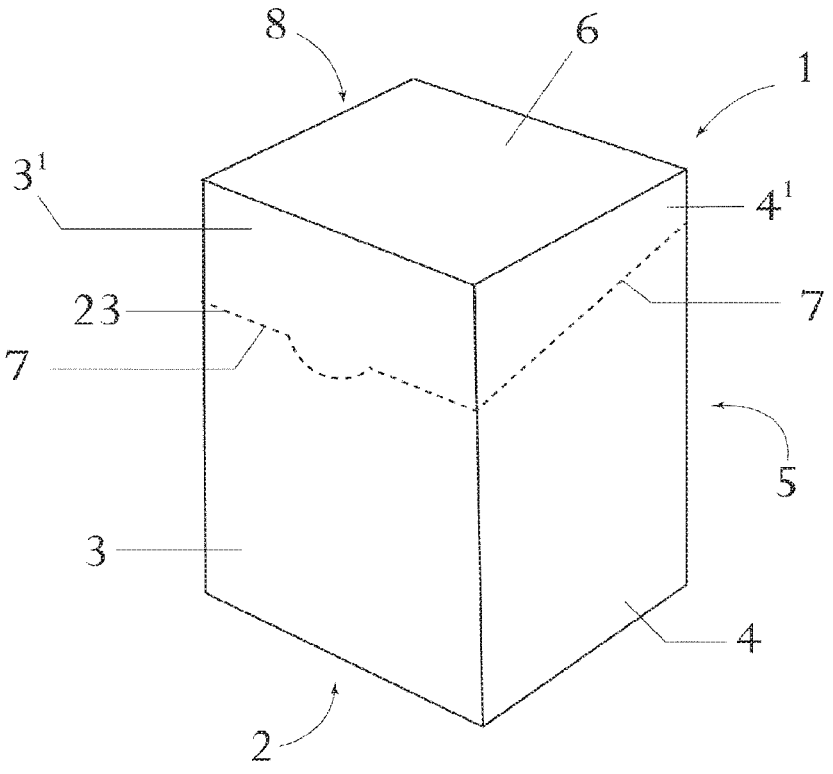
FIG. 1 shows schematically a three-dimensional view of a container according to the present invention before opening.
Figure 2:
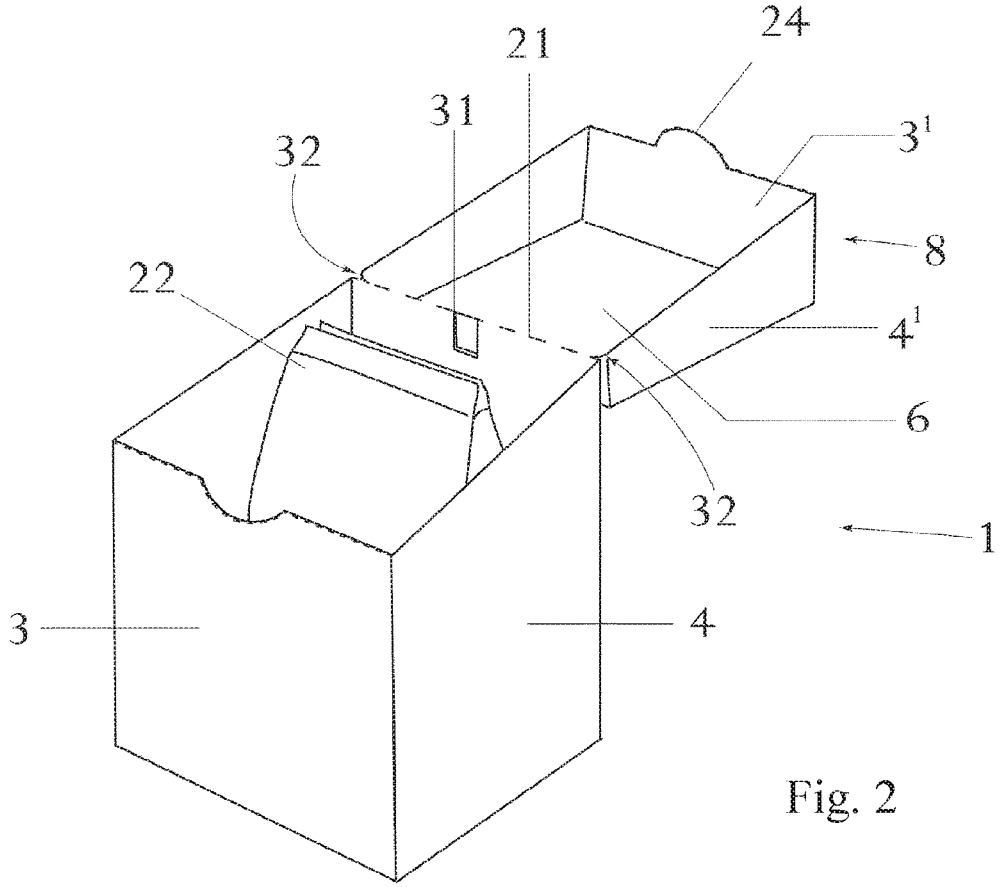
FIG. 2 shows schematically a three-dimensional view of a container according to the present invention with the hingedly connected lid in an open position.

FIG. 1 shows schematically a three-dimensional view of a container 1 according to the present invention before opening, and FIG. 2 shows schematically a three-dimensional view of the container 1 according to the present invention with the hingedly connected lid 8 in an open position. The container 1 comprises a bottom panel 2, a front panel 3, two side panels 4, a rear panel 5, and a top panel 6. In this embodiment of the invention, the front panel 3 and the two side panels 4 each comprises a perforation line 7 which is to be broken when opening the container 1 to gain access to the content thereof. As shown in FIG. 1, the perforation lines 7 in the side panels 4 extend from the rear panel 5 to the front panel 3, and the perforation line 7 in the front panel 3 extends between and connects the two perforation lines 7 in the side panels 4. In the embodiments shown in FIGS. 1 and 2, the perforation lines 7 in the side panels 4 are downwardly sloping from the rear panel 5. However, they may in other embodiments be horizontally arranged.

As seen in FIG. 2 showing the container 1 with the lid 8 being opened, the lid 8 comprises the top panel 6 and upper sections 3',4' of the front panel 3 and of the side panels 4 above the perforation lines 7. After the perforation lines 7 have been broken, the lid 8 is rotationally moveable around a folding line 21 in the rear panel 5. After the first opening, the lid 8 is thus moveable between a closed position resembling what is shown in FIG. 1 but with the perforation lines 7 broken, i.e. where the lid 8 closes the container 1, and an open position as shown in FIG. 2, where an open end of the container 1 is not covered by the lid 8.

In the embodiment shown in FIG. 2, the container 1 contains a pouch 22 stored inside the container 1, which pouch 22 is accessible after opening the lid 8. In other embodiments, the container 1 may contain a plurality, such as two, of such pouches.

The perforation lines 7 in the front panel 3 and in the side panels 4 is a row of perforations 23 arranged along a line or curve which forms an edge 24 of the lid 8 after the perforations 23 have been broken. In the embodiment shown in FIGS. 1 and 2, the perforations 23 in the front panel 3 are arranged linearly along parts of the path and curved along a middle part in order to ease the manual breaking of the perforations 23.

As shown in FIG. 2, the container comprises two parallel and spaced apart transverse cuts 31 which are provided at or near a central part of the folding line 21. These transverse cuts 31 perforate the rear panel 5 through the thickness, and they typically extend substantially symmetrically across and perpendicular to the folding line 21. The effect of these transverse cuts 31 will be clear from the following.

Figure 3:
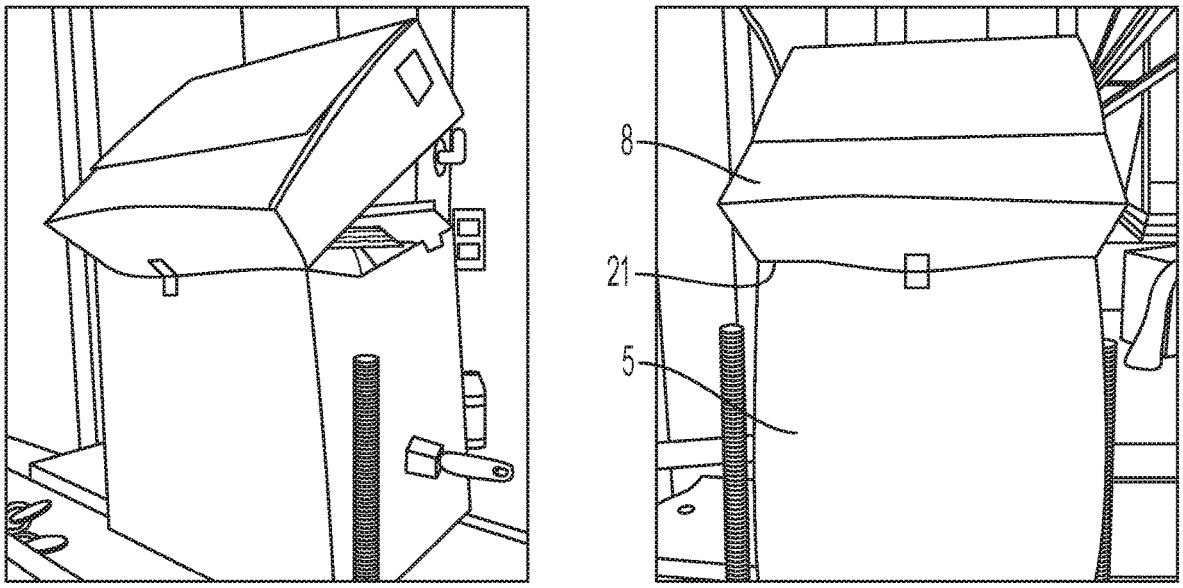
FIG. 3 shows photos of a container having a standard hinge connection (i.e. a hinge connection without the cuts recited in the present application) showing bulging around the hinged connection during opening of the lid.
Figure 4:
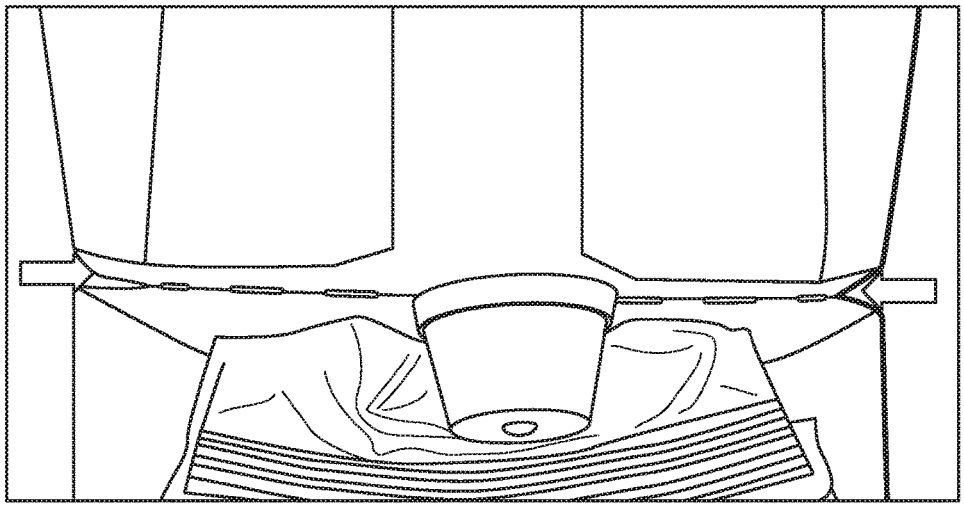
Fig. 4 PRIOR ART
FIG. 4 shows a photo of the container in FIG. 3 and the damage at the ends of the hinged connection.

FIG. 3 shows a photo of a container having an standard hinge connection, such as hinge connections that can be found in prior art containers. The photo shows bulging around the hinged connection during opening of the lid 8. FIG. 4 shows a photo of the container in FIG. 3 and the damage at the ends of the hinged connection at the folding line 21. This damage is considered to a large extent to be caused by the bulging of the rear panel 5.

As further shown in FIG. 2, end cuts 32 are arranged near but at a distance from each end of the folding line 21. These end cuts 32 go through the thickness of the rear panel 5, and the folding line 21 is perforated between the end cuts 32 and the end of the folding line 21 adjacent to the side panels 4. Each of the end cuts 32 preferably extends substantially symmetrically across the folding line 21.

Figure 5:
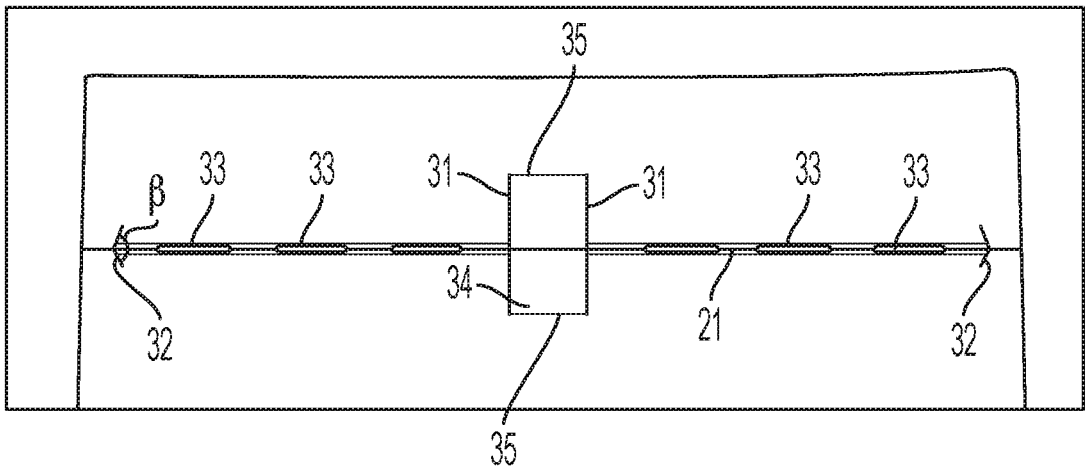
FIG. 5 shows a rear view of the folding line of a closed container according to the present invention.

FIG. 5 shows a rear view of the folding line 21 of a container 1 according to the present invention. In the embodiment shown in FIG. 5, each of the end cuts 32 is provided in the form of two linear and coherent sub-cuts arranged non-perpendicular to the folding line 21. The angle β between the coherent sub-cuts is typically between 90° and 175°; in the embodiment shown it is 125°. It may also be 180°.

Figure 6:
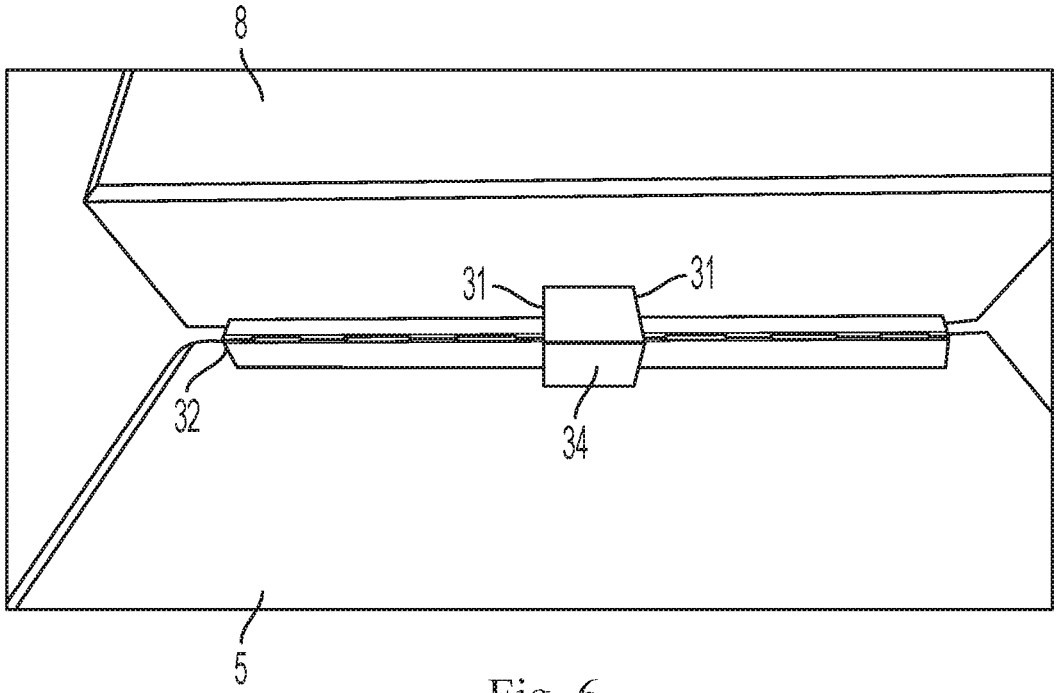
FIG. 6 shows a rear view of the folding line of an open container according to the present invention.

FIG. 6 shows a rear view of the folding line 21 of the container 1 in FIG. 5 after opening. As can be seen, the region 34 between the transverse cuts 31 bends in the opposite direction, i.e. out of the plane of the paper, as compared to the rest of the folding line 21. This is obtained by the embossing lines 35 made so that they connect the ends of the transverse cuts 31 as shown in FIGS. 5 and 6.

Figure 7:
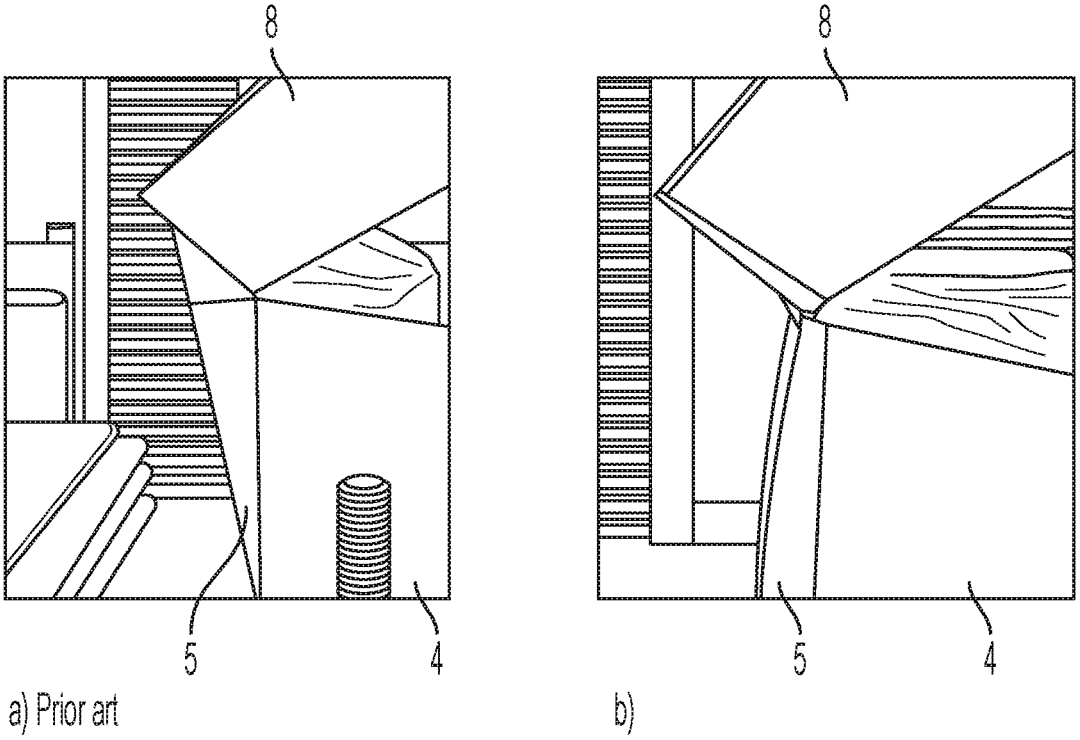
FIG. 7 shows side views of a half-opened known container and a half-opened container according to the present invention, respectively. The photos show the reduced or removed bulging of the rear panel of the container according to the present invention.

FIGS. 7.*a* and 7.*b* show side views of a half-opened known container and a half-opened container according to the present invention, respectively. The photos show the reduced or removed bulging of the rear panel 5 in a container 1 according to the present invention.

In some embodiments of the invention, including the one shown in FIGS. 5 and 6, the folding line comprises a row of discontinuous perforations 33 extending along the folding line 21. This has been found to reduce the re-closing force when the container 1 has been opened. These perforations 33 may further ease the first opening of the lid 8 along the folding line 21 and thereby reduce the risk of bulging which could otherwise induce damage to the folding line 21 as described above.

Figure 8:
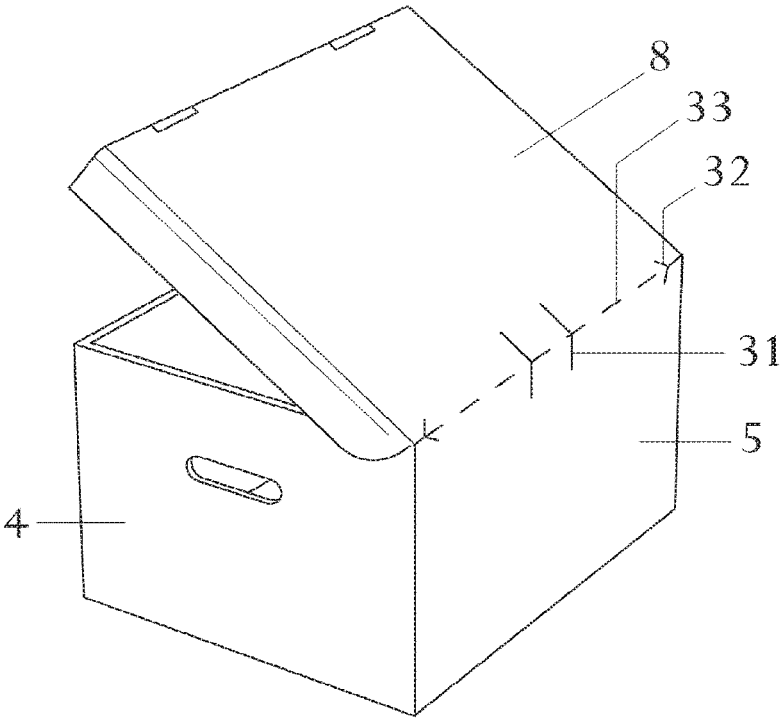
FIG. 8 shows schematically another embodiment of the present invention.

FIG. 8 shows another embodiment of the present invention, wherein the lid is not obtained by breaking a perforation line. In this embodiment, the folding line is at the edge between the rear panel 5 and the upper panel 6. The vertical cuts 31, the end cuts 32 and the perforations 33 along the folding line are thus also arranged along that edge.

Figure 9:
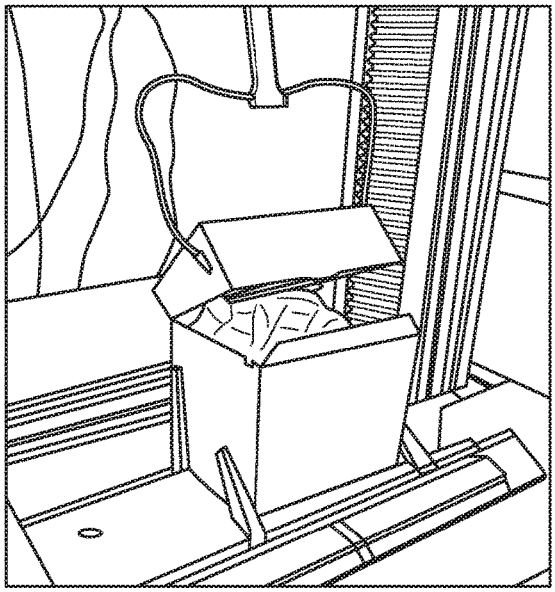
FIG. 9 shows results of tests made to study the force needed to open known containers and containers according to the present invention, respectively.
Figure 9:
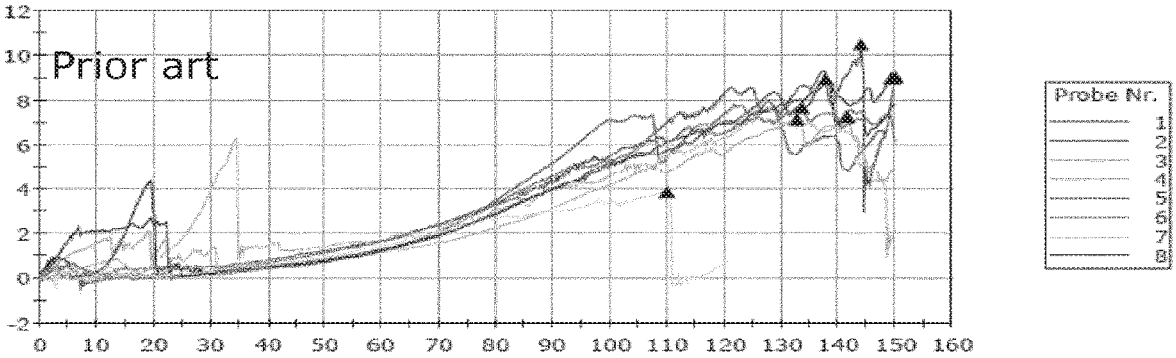
Figure 9:
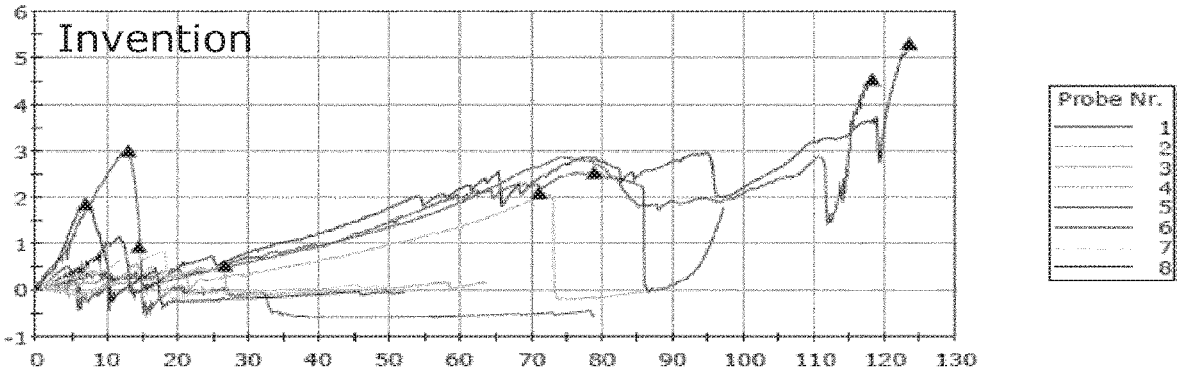

FIG. 9 shows results of tests made to study the force needed to open containers having a standard hinge connection, as found on prior art containers, and containers according to the present invention, respectively. The test set-up is shown in FIG. 9.*a*. In order to compare the improved hinge with the known hinge, both types of containers, i.e. with the known hinge and the hinge of the container of the invention, respectively, have been opened in a defined way by using a tensile tester which was set-up with a speed of 100 mm/min. The load cell was connected to the containers with a wire being connected through holes in the lids. Since the bulging of the container only occurs in case the container is being squeezed from the side, a spanner has been used in order to squeeze the container along the width before the opening process was simulated. FIGS. 9.*b* and 9.*c* show the test curves of the prior art containers and containers according to the present invention, respectively. The travel measured in mm is shown along the x-axis, and the forces measured in N is shown along the y-axis. FIGS. 9.*d* and 9.*e* show the test results for the curves in FIGS. 9.*b* and 9.*c*, respectively. As can be seen from the tables, the forces measured for opening the containers according to the present invention are significantly lower than those needed to open previously known designs.

Figure 10:
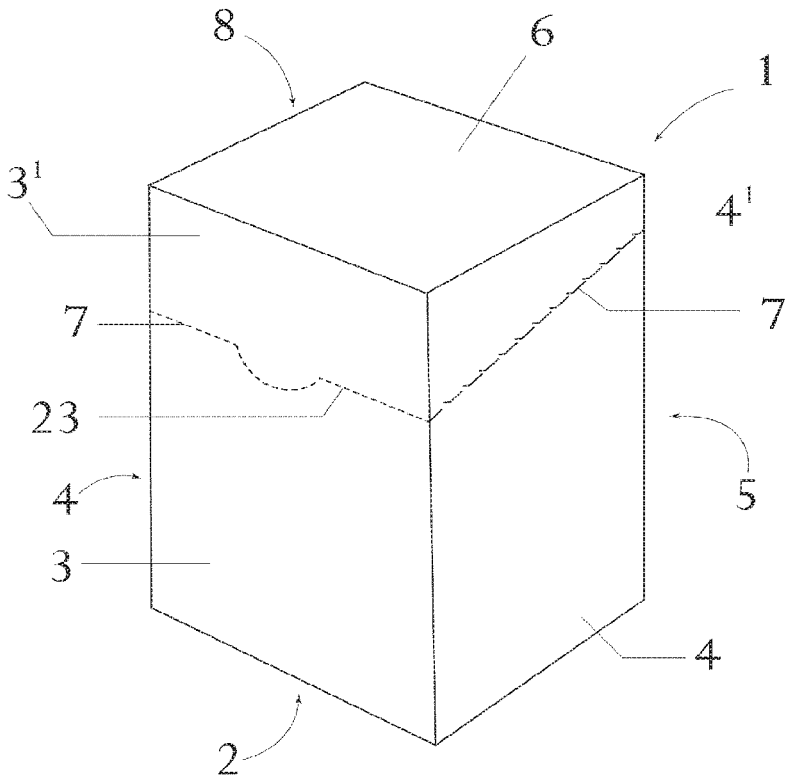
FIG. 10 shows schematically a three-dimensional view of an embodiment of the present invention provided with means for facilitating the opening of the perforation lines in the side panels.
Figure 10:
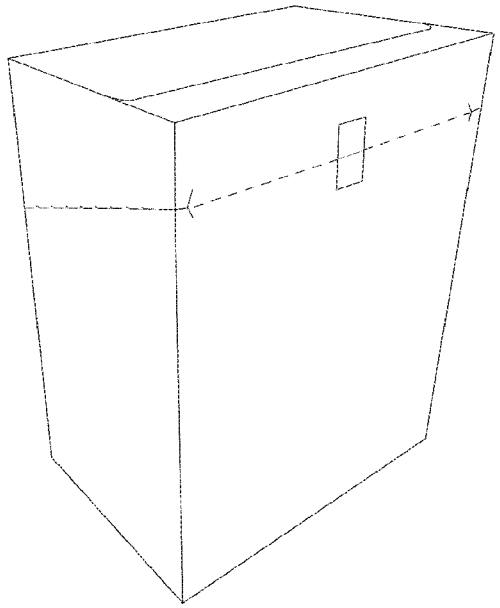
Figure 11:
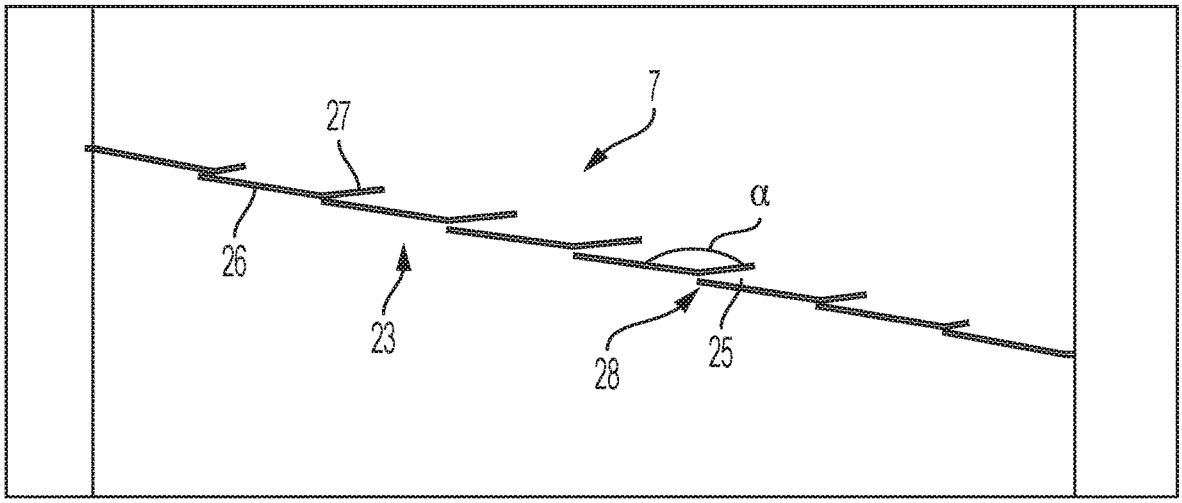
FIG. 11 shows an example of a perforation line on the side panels of the container in FIG. 10; the perforation line having tooth-shaped regions.

FIG. 10.*a* shows schematically a three-dimensional view of an embodiment of the present invention provided with means for facilitating the opening of the container. FIG. 10.*b* shows a side-rear view of the container in FIG. 10.*a*. The facilitation of the opening of the container 1 is obtained by the design of the perforation lines 7 in the side panels 4 as shown in FIG. 11 which is a photo showing a perforation line 7 having tooth-shaped regions 25. The perforation line 7 comprises two coherent first and second cuts 26,27 with a blunt angle $\alpha$ there between. These perforations 23 are arranged to provide a row of tooth-shaped regions 25, where each tooth-shaped region 25 is delimited by a first cut 26 and a second cut 27, respectively, from two mutually adjacent but non-coherent perforations 23. The first cuts 26 are arranged parallel to each other but staggered so that they are not arranged along one line. In the embodiments shown in FIGS. 10 and 11, tips 28 of the tooth-shaped regions 25 are directed towards the rear panel 5.

Experiments performed in relation to the present invention have shown that the design of the perforation lines 7 as described above and shown in the figures results in a container 1 which meets the objectives of the present invention as described above. For the experiments, containers 1 of the same size but having the following downwardly sloping perforation lines 7 in the side panels 4 were tested: no teeth (i.e. linear perforations), five teeth and seven teeth. The tests were performed by using a standard tensile testing machine which was opening the container with a defined speed of 100 mm/min. For opening the containers with the tensile testing machine, a hole was cut through each of the lids of the containers, and a wire connected to the load cell was guided through this hole. The results showed that the average force needed to break the perforations 23 and thereby open the lid 8 was highest for the design with no teeth (i.e. with linear perforations) and lower for the design with seven teeth than for a design with five teeth. The results showed a significantly larger damage around the area where the force was applied for the sample with no teeth than for the other samples. For the sample with seven teeth, very limited damage is seen at the area where the force was applied. This indicates that this perforation line is easier opened.

Figure 12:
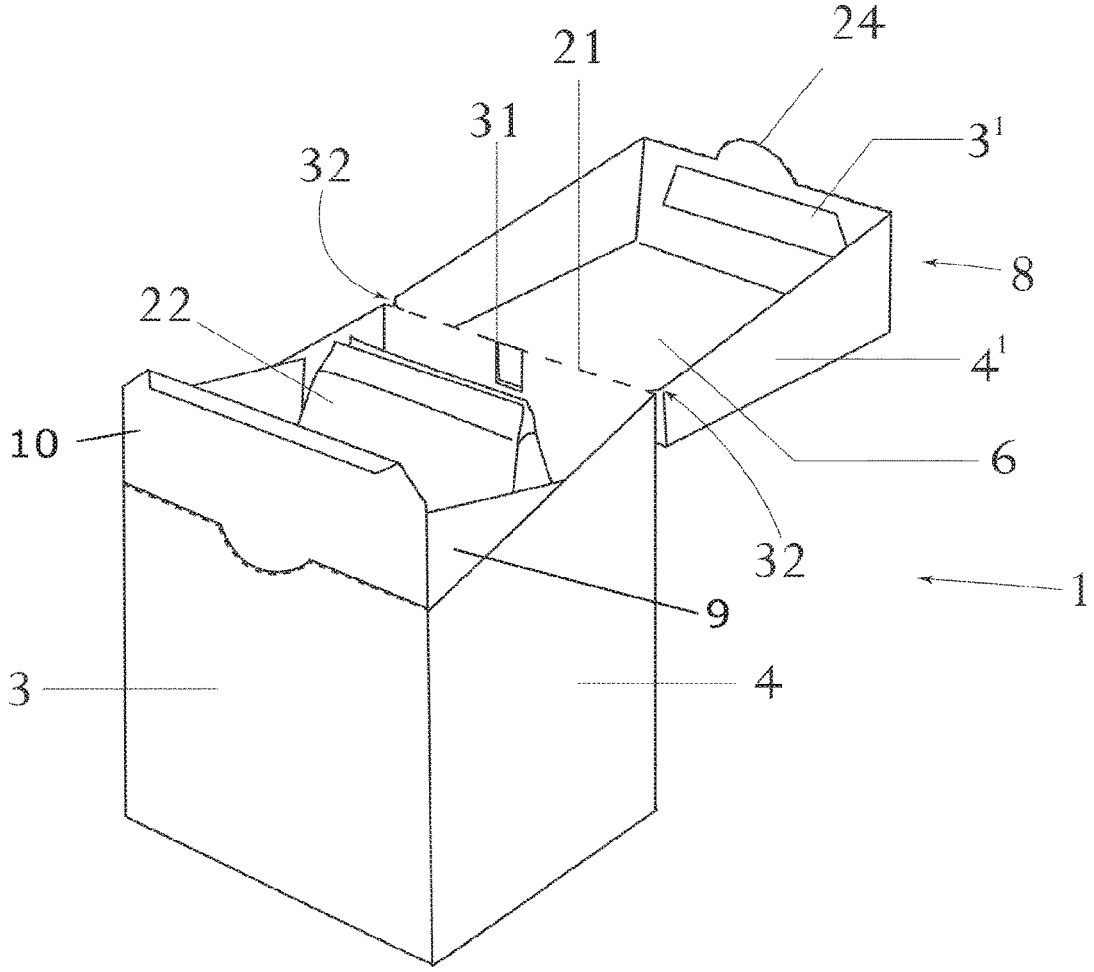
FIG. 12 shows another embodiment of the present invention comprising means for improved re-closing properties of the container.
Figure 13:
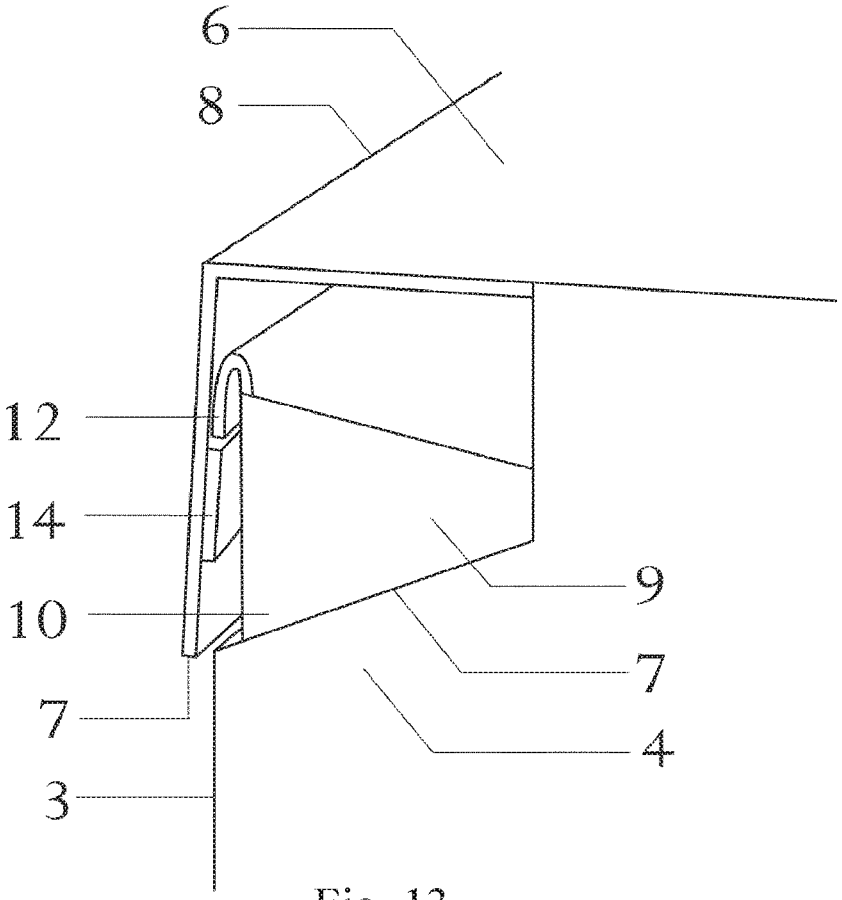
FIG. 13 is a close-up perspective and schematic illustration of a section of the container of FIG. 11; the section is shown with some material removed to reveal a part of the interior container.
Figure 14:
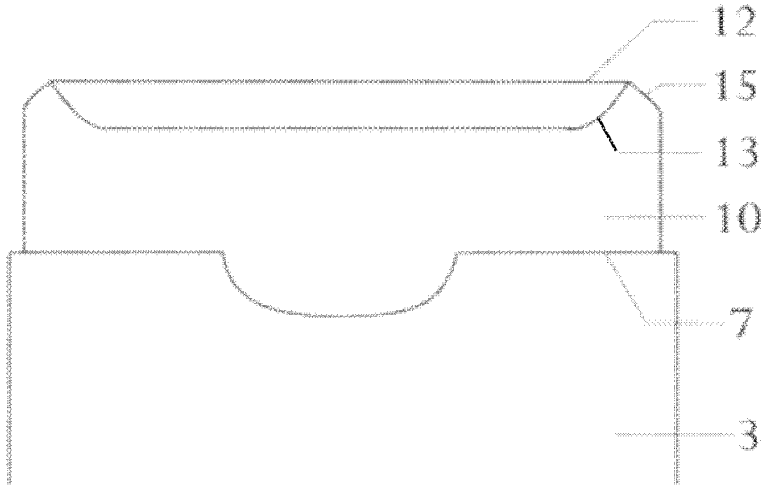
FIG. 14 is a schematic illustration of a region of the container in FIG. 11, the container is illustrated from the front, and only the inner front part and a part of the front panel is disclosed.

FIG. 12 shows another embodiment of the present invention comprising means for improved re-closing properties of the container 1. FIG. 13 is a close-up perspective and schematic illustration of a section of the container 1 of FIG. 12; the section is shown with some material removed to reveal a part of the interior container. FIG. 14 is a schematic illustration of a region of the container in FIG. 12, the container is illustrated from the front, and only the inner front part and a part of the front panel is disclosed.

In order to provide an easy reclosing of the container 1, the front panel 3 in the embodiment in FIGS. 12-14 comprises an inner front part 10 extending above the division line 7 in the front panel 3 without being attached to the front panel 3 above the division line 7. Further, each side panel 4 comprises an inner side part 9 extending above the division line 7 in the side panel 4 without being attached to the side panel 4 above the division line 7. Advantageously, the upper margin of each of the inner side parts 9 extends downwardly sloping towards the rear panel 5, as shown in FIG. 12. This downward sloping towards the rear panel 5 may be seen as providing a guide which prevents the sections 4' from engaging unintentionally with inner side part 9.

While the inner side parts 9 reduce the risk of unintentional engagement of the sections 4', the section 3' may still be prone to un-intentional engagement with the inner front part 10. In order to further reduce this risk, the inner front part 10 comprises a flap 12 (see FIG. 13) extending downwardly from an upper margin of the inner front part 10. This flap 12 is arranged so that it abuts an inner surface of the section 3' of the front panel 3 above the division line 7 when the lid 8 is in the position where it closes the container 1. In the situation, where the lid 8 is in the position where the container is open, the flap 12 extends downwardly and outwardly, where the outwardly extending typically is provided by the material being resilient and the flap is provided by folding along a folding line which after folding is the upper margin of the inner front part 10.

As seen in FIG. 13, there is provided a vertical distance between the upper most part of the inner side part 9 and the upper margin of the inner front part 10 from which the flap 12 extends downwardly. Thus, the upper margin of the inner front part 10 is higher than the upper most part of the inner side parts 9. This assists in an easy reclosing of the container, as the lid when moved towards it closing position will initially be guided by flap 12 to deflect the section 3' outwardly and/or the inner front part 10 inwardly.

When the lid 8 is moved from the open position shown in FIG. 12 to the closed position, after section 3' meets the inner front part 10, thus guiding the section 3' outwardly and/or the inner front section 10 inwardly, the upper margins of the inner side parts 9 will in turn guide the sections 4' outwardly and/or the sections 4' will guide the inner side parts 9 inwardly Thereby an easy reclosing of the container 1 is provided.

In a preferred embodiment, the inner front part 10 is provided by a panel provided on the inside of the front panel 3 below the division line 7 in the front panel 3, and the inner side parts 9 are provided by panels provided on the inside of the side panels 4 below the division line 7. Such panels may be separate panels which are attached to the inside of the panels of the container 1, e.g. by gluing and/or welding. However, in some preferred embodiments, the panels used as inner side parts 9 and inner front part 10 are made from a single sheet being folded into an insert so as to fit inside the container. It is further noted that in the latter case, the folded single sheet may not need to be attached to the inside of the container as it may be given a longitudinal extension so that it may rest at the bottom panel 2 of the container. However, also in this case, it may be advantageous to attach the inset to the inside of the container 1.

It is often preferred that the container is prevented from being opened unintentionally and a locking mechanism is often preferred, which locking mechanism should preferably provide a tactile and/or a hearable response to inform the user that the container is closed and locked. To this, the the lid 8 may be provided with a ledge 14 provided on the inner surface of the section 3' of the front panel 3 above the division line 7 in a position where the lower margin of the downwardly extending flap 12 engages with an upper edge of the ledge 14, when the lid 8 is in the position where it closes the container 1.

Thereby, the flap 12 will, when the lid 8 is to be positioned in the closed position, bend inwardly and/or the section 3' will bend outwardly until the flap 12 is able to bend outwardly. This may provide a snapping of the flap 12 which, depending on the strength of the material used for the container, provide a hearable and/or a tactile snap. The position at which the container is locked is shown in FIG. 13, which illustrates the interior of the container at an upper corner with a part of the section 4' cut away for illustration only.

In order to e.g. provide sufficient space for maneuvering the flap 12 into the position where it engages with the ledge 14, the ledge 14 and the flap 12 are mutually arranged so as to provide a distance between the upper margin of the inner front part 10 and the inner surface of the top 6, when the lid 8 is in the position where it closes the container 1.

In order to further facilitate easy reclosing of the container, sharp and/or pointing corners could advantageously be removed, and in the preferred embodiment shown in FIGS. 12-14, the corners 13 of the flap 12 and/or corners 15 of the inner front part 10 are preferably rounded and/or truncated as shown in FIG. 14. Typical size for the truncation is 45 degrees as shown in FIG. 14, where the corners 15 of the inner front part 10 and the corners 13 of the flap 12 are truncated. In addition, in the embodiment shown in FIG. 14 the corners are furthermore rounded; such roundings may be omitted.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A container comprising:

a main part comprising a bottom panel, a front panel, two side panels, a top panel, and a rear panel;

a lid which is rotationally moveable around a folding line in the rear panel between a closing position where the lid closes the container, and an open position where an open end of the main part of the container is not covered by the lid;

the front panel and the two side panels each comprise a division line, the division lines in the side panels extend from the rear panel to the front panel, and the division line in the front panel extends between and connects the two division lines in the side panels, thereby defining the lid, the lid comprising the top panel, an upper section of the front panel, and upper sections of the two side panels, respectively, above the division lines, wherein the division lines are perforation lines each comprising a row of perforations which are configured to be broken to enable opening of the lid, the perforation line in the front panel is a row of perforations arranged along a line or curve which forms an edge of the lid after the perforations have been broken, each of the perforation lines in the side panels is a row of perforations each comprising two coherent first and second cuts with an obtuse angle therebetween, these perforations arranged to provide a row of tooth-shaped regions, wherein each tooth-shaped region is delimited by a first cut and a second cut, respectively, from two mutually adjacent but non-coherent perforations, the first cuts are arranged parallel to each other but staggered so that they are not arranged along one line;

at least two parallel and spaced apart transverse cuts are provided at or near a central part of the folding line, the transverse cuts perforating the rear panel through a thickness of the rear panel, and the transverse cuts extending substantially symmetrically across and perpendicular to the folding line;

embossing lines connecting ends of the transverse cuts; and a region between the transverse cuts configured to bend away from the folding line when the lid is in the open position, the region between the transverse cuts has a rectangular shape.

2. The container according to claim 1, wherein a number of the transverse cuts is two.

3. The container according to claim 1, wherein an end cut is provided near but at a distance from each end of the folding line, the end cuts going through a thickness of the rear panel, and the folding line being perforated between the end cuts and the end of the folding line adjacent to the side panels.

4. The container according to claim 3, wherein each of the end cuts extends substantially symmetrically across the folding line.

5. The container according to claim 3, wherein each of the end cuts is provided in two linear and coherent sub-cuts form arranged non-perpendicular to the folding line.

6. The container according to claim 5, wherein the obtuse angle between the two linear and coherent sub-cuts is between 145° and 175°.

7. The container according to claim 1, wherein the folding line comprises a row of discontinuous perforations extending along the folding line.

8. The container according to claim 1, wherein:

the division line extends downwardly sloping from the rear panel in the side panels and horizontally in at least a part of the front panel;

the front panel further comprises an inner front part extending above the division line in the front panel without being attached to the front panel above the division line;

each side panel further comprises an inner side part extending above the division line in the side panel without being attached to the side panel above the division line, the upper margin of each of the inner side parts extending downwardly sloping towards the rear panel; and the inner front part comprises a flap extending downwardly from an upper margin of the inner front part and abutting an inner surface of the section of the front panel above the division line when the lid is in the position where it closes the container.

9. The container according to claim 1, wherein the container contains at least one pouch stored inside the container and the at least one pouch is accessible after opening the lid.

10. The container according to claim 1, wherein a tip end of the first cut of each tooth-shaped region is directed toward the rear panel.

11. The container according to claim 1, wherein a length of the second cut of each tooth-shaped region is superimposed over the first cut of a subsequent adjacent tooth-shape region.

12. A method of producing a container, the container comprising a main part comprising a bottom panel, a front panel, two side panels, a top panel, and a rear panel, a lid which is rotationally moveable around a folding line in the rear panel between a closing position where the lid closes the container, and an open position where an open end of the main part of the container is not covered by the lid, the front panel and the two side panels each comprise a division line, the division lines in the side panels extend from the rear panel to the front panel, and the division line in the front panel extends between and connects the two division lines in the side panels, thereby defining the lid, the lid comprising the top panel, an upper section of the front panel, and upper sections of the two side panels, respectively, above the division lines, wherein the division lines are perforation lines each comprising a row of perforations which are configured to be broken to enable opening of the lid, the perforation line in the front panel is a row of perforations arranged along a line or curve which forms an edge of the lid after the perforations have been broken, each of the perforation lines in the side panels is a row of perforations each comprising two coherent first and second cuts with an obtuse angle therebetween, these perforations arranged to provide a row of tooth-shaped regions, wherein each tooth-shaped region is delimited by a first cut and a second cut, respectively, from two mutually adjacent but non-coherent perforations, and the first cuts are arranged parallel to each other but staggered so that they are not arranged along one line, at least two parallel and spaced apart transverse cuts are provided at or near a central part of the folding line, the transverse cuts perforating the rear panel through a thickness of the rear panel, and the transverse cuts extending substantially symmetrically across and perpendicular to the folding line, embossing lines connecting ends of the transverse cuts, and a region between the transverse cuts configured to bend away from the folding line when the lid is in the open position, the region between the transverse cuts has a rectangular shape, the method comprising:

folding the bottom panel, the front panel, the two side panels and the rear panel from one piece of material or joining separate sheets of material.

13. A method for storing a food product, the method comprising placing food in a container, the container comprising a main part comprising a bottom panel, a front panel, two side panels, a top panel, and a rear panel, a lid which is rotationally moveable around a folding line in the rear panel between a closing position where the lid closes the container, and an open position where an open end of the main part of the container is not covered by the lid, the front panel and the two side panels each comprise a division line, the division lines in the side panels extend from the rear panel to the front panel, and the division line in the front panel extends between and connects the two division lines in the side panels, thereby defining the lid, the lid comprising the top panel, an upper section of the front panel, and upper sections of the two side panels, respectively, above the division lines, wherein the division lines are perforation lines each comprising a row of perforations which are configured to be broken to enable opening of the lid, the perforation line in the front panel is a row of perforations arranged along a line or curve which forms an edge of the lid after the perforations have been broken, each of the perforation lines in the side panels is a row of perforations each comprising two coherent first and second cuts with an obtuse angle therebetween, these perforations arranged to provide a row of tooth-shaped regions, wherein each tooth-shaped region is delimited by a first cut and a second cut, respectively, from two mutually adjacent but non-coherent perforations, and the first cuts are arranged parallel to each other but staggered so that they are not arranged along one line, at least two parallel and spaced apart transverse cuts are provided at or near a central part of the folding line, the transverse cuts perforating the rear panel through a thickness of the rear panel, and the transverse cuts extending substantially symmetrically across and perpendicular to the folding line, embossing lines connecting ends of the transverse cuts, and a region between the transverse cuts configured to bend away from the folding line when the lid is in the open position, the region between the transverse cuts has a rectangular shape.

14. The method according to claim 13, wherein a tip end of the first cut of each tooth-shaped region is directed toward the rear panel.

15. The method according to claim 13, wherein a length of the second cut of each tooth-shaped region is superimposed over the first cut of a subsequent adjacent tooth-shape region.

* * * * *